US006435867B1

(12) United States Patent
Carr et al.

(10) Patent No.: US 6,435,867 B1
(45) Date of Patent: Aug. 20, 2002

(54) FURNACE ROLLER AND CAST TIRE THEREFOR

(75) Inventors: Hugh B. Carr, *deceased*, late of McMurray, by Marion M. Carr, executrix; William Goodlin, McMurray, both of PA (US)

(73) Assignee: Bricmont, Inc., Cannonsburg, PA (US)

( * ) Notice: Subject to any disclaimer, the term of this patent is extended or adjusted under 35 U.S.C. 154(b) by 0 days.

(21) Appl. No.: 09/710,484

(22) Filed: Nov. 10, 2000

(51) Int. Cl.[7] ..... F27D 3/00

(52) U.S. Cl. ..... 432/236; 432/246; 29/894.354; 29/895.213

(58) Field of Search ..... 432/236, 246; 492/28, 30, 33, 39; 29/895.21, 895.213, 894.354; 301/111.01, 111.04; 403/370, 371, 374

(56) References Cited

U.S. PATENT DOCUMENTS

| | | | | |
|---|---|---|---|---|
| 4,991,276 A | | 2/1991 | Bricmont | |
| 5,145,277 A | * | 9/1992 | Fujita et al. | 403/374 |
| 5,230,618 A | | 7/1993 | Bricmont et al. | |
| 5,341,568 A | * | 8/1994 | Bricmont et al. | 29/895.32 |

* cited by examiner

*Primary Examiner*—Jiping Lu
(74) *Attorney, Agent, or Firm*—Clifford A. Poff

(57) ABSTRACT

There is provided a cast tire for use with a furnace roller. The cast tire has at least three of annular spaced pockets located around the central opening of the tire on each radial side. When the tires are installed on a furnace roller with arbor means, pockets are inserted into the annular spaced pockets. The pockets are secured only to the arbor means of the roller. Rotation of the arbor means results in rotation of the cast tires by transmission of torque from the pockets to the to the tire without direct attachment of the tire to the arbor means.

27 Claims, 6 Drawing Sheets

FURNACE ROLLER AND CAST TIRE THEREFOR

CROSS-REFERENCE TO RELATED APPLICATIONS

Not applicable.

BACKGROUND OF THE INVENTION

1. Field of the Invention

The present invention relates to an improved furnace roller to advance a metallic workpiece through a reheat furnace and more particularly to a tire construction and securement structure for mounting the tire to an arbor which includes the provision of a core buster for cooling of the arbor.

2. Description of Related Art

Furnace rollers are used to support and guide metallic workpieces through a furnace. U.S. Pat. No. 4,991,276 discloses of one type of furnace roller that is applicable to the present invention. The furnace roller includes a plurality of wheel members welded at spaced apart locations along to an outer tubular member used to form the arbor. The wheel member includes inner hub sections formed of a plurality of angularly spaced-based members. Each base member has a toe portion and head portion separated by a gap extending in the direction of the arbor. A short length of weld at the lateral side of each toe portion interconnects the toe portion to the outer tubular member. The head portion is unattached and free to slide relative to the outer tubular member of the arbor in response to the effect of differential expansion caused by a relatively large thermal gradient in the roller and the bending effect by the weight of the strip upon the roller. A web portion extends from each base member. Each web portion is angularly separated from an adjacent web section by an elongated open space that projects outward slightly short of the inner radius of the rim. The open space further serves to reduce and impede heat flow to the arbor by way of the base member. Apertures are provided in the web portion to provide passage for metal rods used to secure a complement of thermally-insulating discs between the wheel members and thereby provide thermal protection from the high temperature environment in the furnace.

A different furnace roller construction uses castable refracting to form the insulation barrier between wheels is initially covered with a thermal resistant insulating material as disclosed in U.S. Pat. No. 5,230,618. When the roller is used in furnaces operating at approximately 2000° F. or higher, the insulating material can be damaged and separate from the roller in the vicinity of a tire the edge by a terminal or leading edge of a strip. Exposure of the tire's radial sides to the furnace operating temperatures causes thermally induced metal fractures to occur between the open spaces and apertures in the wheel hub. When multiple fractures between the open spaces and apertures the fractures lead to the separation of the rim from its hub.

Research into the causes of the metal fracture led to the apertures and constructing the head portions of the base members flush with the hub. With furnaces operating at temperatures above 2100° F., this design results in occasional fracturing across the tire's rim without protective insulating material. One particular thermal study of this furnace roller in a 2100° F. atmosphere with the toe portion of the base member welded to a water-cooled shaft revealed the following conditions. The rim temperature was 2026° F. with a radial displacement of the rim equal to 0.1228-inch on its radius. The temperature of the toe portion at the weld connection to a watered-cooled shaft was 400° F., with a displacement of 0.008-inch and a bending stress in the base member of 76,212 psi. With this configuration, the 400° F. base members restrain the wheel rim from expanding. This phenomenon accounts for the rim fractures observed in actual furnace operations. An advantage exists, therefore, for a tire that will permit the rim to expand to prevent rim fractures from occurring when operating in an environment with temperatures above 2000° F. The use of weld metal to establish a metal-to-metal connection between the wheels and the arbor of a furnace roller when eliminated will permit the wheel's rim to expand when operating in the extreme temperature environment to which reference has been made.

It is therefore an object of the present invention to provide an improved tire that eliminates the base member with direct toe connection of the tire to the shaft of the furnace roll and allows the rim of the tire to expand to prevent fractures from occurring when operating in the extreme temperature environment to which reference has been made.

It is another object of the present invention to provide improved furnace rollers using the improved tires of the present invention that will allow operation of the rollers in the extreme temperature environment to which reference has been made for long periods of operating times without fracturing of the tires.

BRIEF SUMMARY OF THE INVENTION

More particularly according to the present invention there is provided a cast tire for use in a furnace roller to support and advance a workpiece in a furnace, the cast tire including, a rim portion having an annular peripheral tire face to engage and support a workpiece during conveyance thereof in a heated chamber of a furnace, and a continuous web portion having an inner most annular surface contiguous with the outer rim portion, the inner most annular surface defining a load-bearing seat for load-bearing support by an axle, the continuous web having oppositely directed radial face surfaces forming boundaries of angularly spaced pockets bounded by radial edges generally perpendicular to the inner most annular surface, the radial edges being elongated to form moment arms to transmit torque from an applied force by an axle to rotate the continuous web and the rim portion for conveying a workpiece.

The present invention further provides a furnace roller for supporting a workpiece in a furnace, the furnace roller including a rotatable arbor, a number of tires having substantially equal radial extending rim portions at axially spaced apart sites along the arbor for engaging a workpiece, each tire further comprising a continuous web portion having an inner most annular surface contiguous with the outer rim portion, the inner most annular surface defining a load-bearing seat for load-bearing support by an axle, the continuous web having oppositely directed radial face surfaces forming boundaries of angularly spaced pockets bounded by radial edges generally perpendicular to the inner most annular surface, the radial edges being elongated to form moment arms to transmit torque from an applied force by an axle to rotate the continuous web and the rim portion for conveying a workpiece, a plurality of anchor members seated in the pockets and drivingly secured to the arbor for rotation by the arbor; and thermal insulation supported by the arbor to provide a thermal barrier to extend radially between the tires, the insulation having a thickness terminating with an outer surface extending radially at least a substantial portion but less than the entire radii of the tires.

BRIEF DESCRIPTION OF THE SEVERAL VIEWS OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
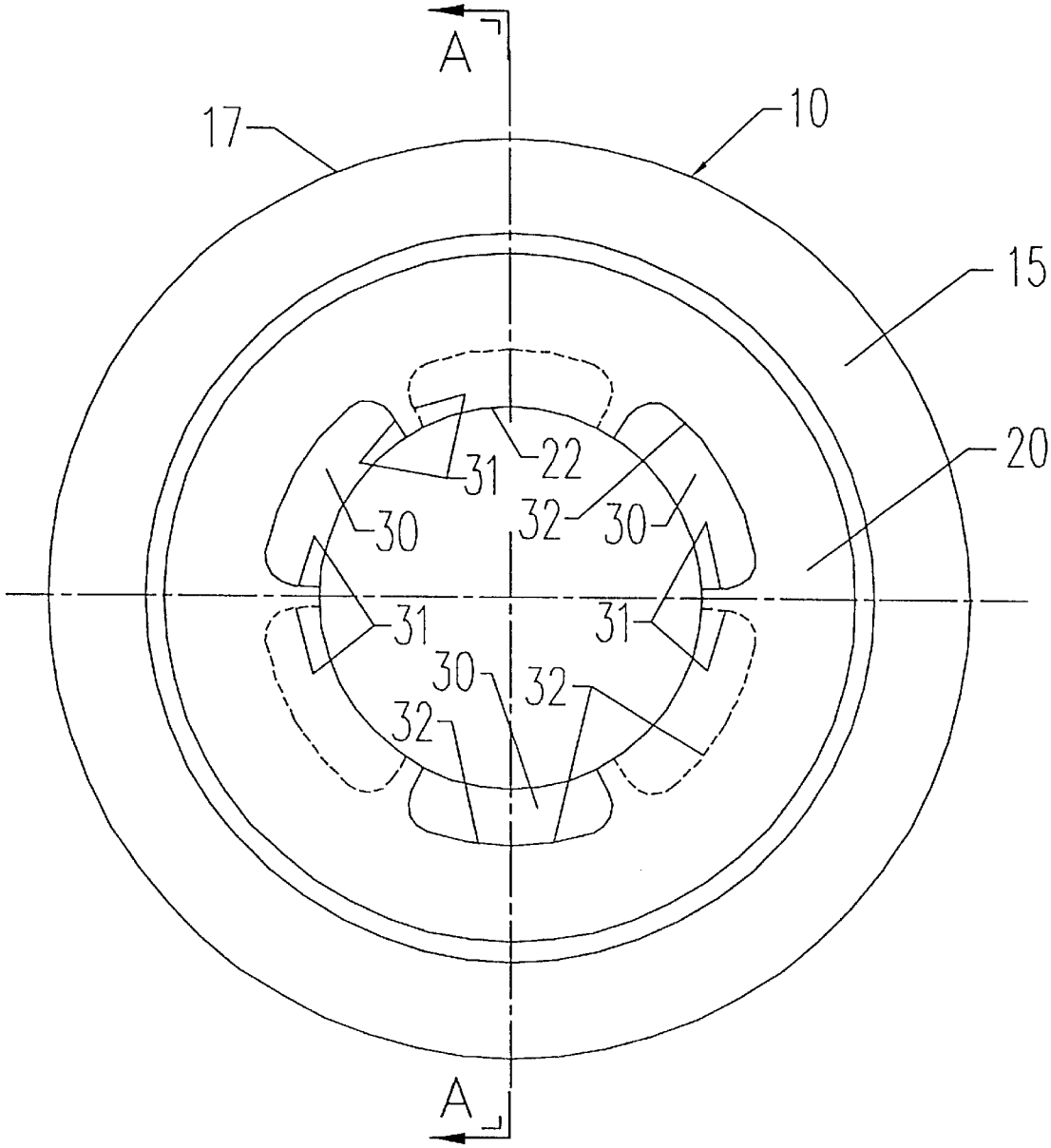
FIG. 1 is a plan view of a radial side of the tire of the present invention.
Figure 2:
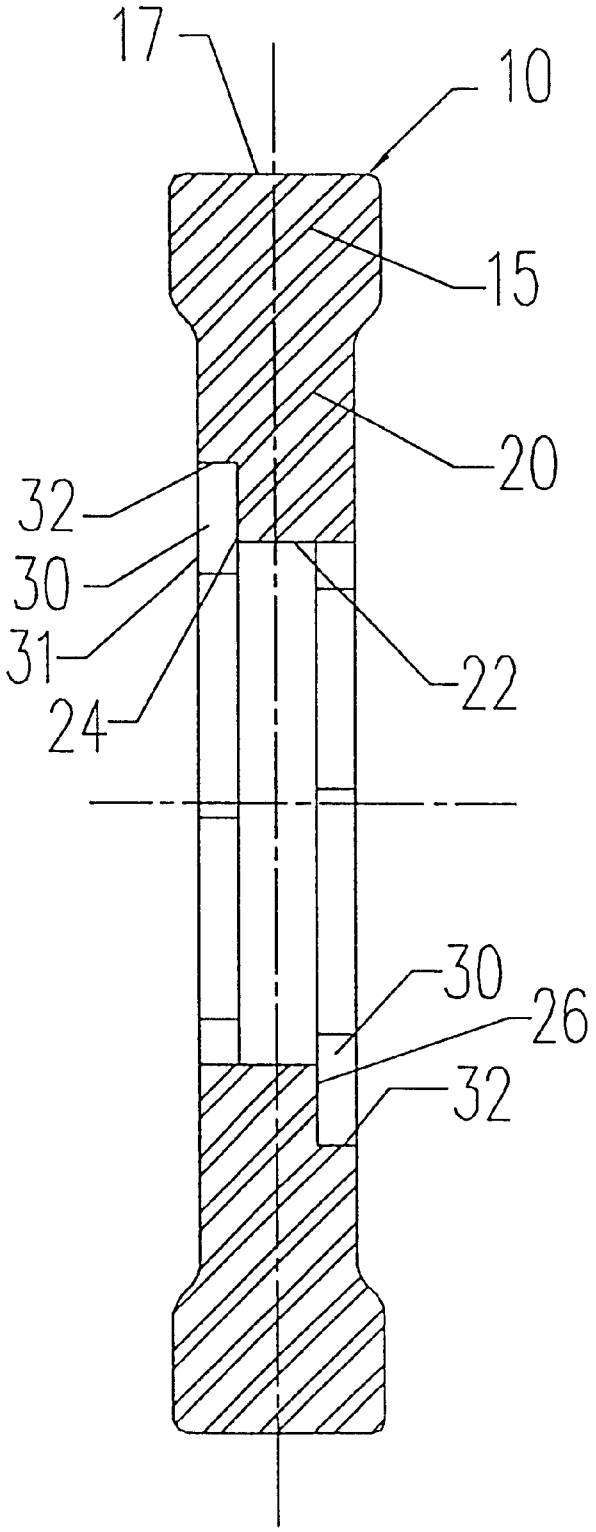
FIG. 2 is a sectional view taken along lines A—A of FIG. 1.

A furnace roller of the present invention embodies a novel design for a cast wheel or tire shown in FIG. 1 and 2. The tire 10 is cast from a thermally dimensionally stable and heat-resistant metal material such as a high temperature nickel-chrome alloy or cobalt-chrome alloy, or the like, to minimize thermal effects of operating in a high temperature environment at temperatures above 2000° F. The tire 10 includes an enlarged outer rim portion 15 providing an annular peripheral tire face surface 17 for engaging and supporting a metal workpiece such as a strip during conveyance of the workpiece in the heating chamber of a furnace particularly a tunnel furnace.

The cast tire 10 essentially also includes a thinner, as compared to the thickness of rim portion 15 as shown in FIG. 2, a continuous web portion 20 continuous with the rim portion 15. The continuous web portion 20 has an inner most annular surface 22 appearing as a central opening and a load-bearing seat for load-bearing support by an axle, preferably an arbor with the tire forming one of a number of such tires on an arbor as part of a furnace roller, as will be described in greater detail hereinafter. The continuous web 20 is further defined by oppositely directed radial face surfaces 24 and 26 each containing angularly spaced pockets 30 bounded by radial edges 31 generally perpendicular to the inner most end annular surface 22. The radial edges 31 of each pocket are elongated to form moment arms to develop torque from an applied force to an axle to rotate the continuous web portion 20 and thereby also the rim portion 15 for conveying a workpiece. The pockets 30 are used to seat anchor members 40 as further described below. The pockets 30 are axially spaced around the annular surface 22 on each radial side of the hub portion 20. In the preferred embodiment, all pockets 30 are substantially equal in size and the axial spacing between all adjacent pockets on each radial side of the hub portion are equal. Furthermore, in the preferred embodiment, pockets on the opposing sides of the hub portion 20 are axially offset by a spacing substantially equal to half the axial spacing between adjacent pockets. The pockets 30 for the opposing side of the cast tire 10 are shown in phantom in FIG. 1. In the preferred embodiment shown in FIGS. 1 and 2 with three pockets on each of the two sides of the tire, the slots are spaced apart by 120 degrees and radially offset from each other by 60 degrees. Each pocket 30 has an arcuate top surface 32 between the radial edges 31.

Figure 3:
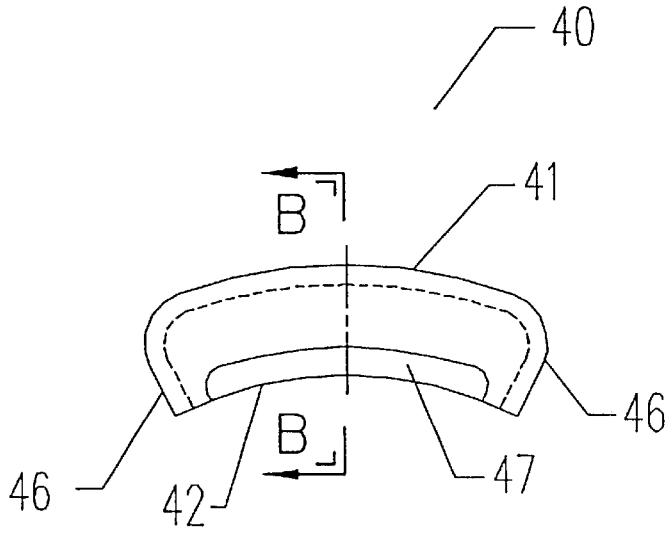
FIG. 3A is a plan view of the pocket used with the tire of the present invention.
FIG. 3B is a sectional view taken along lines B—B of FIG. 3A.
Figure 3:
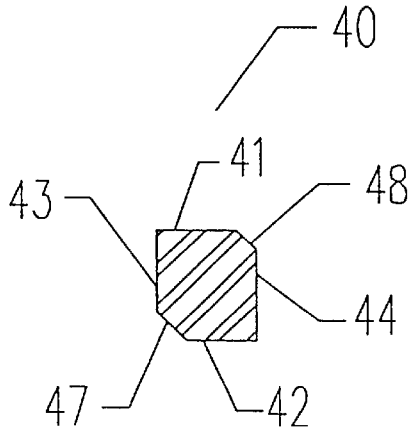
Figure 4:
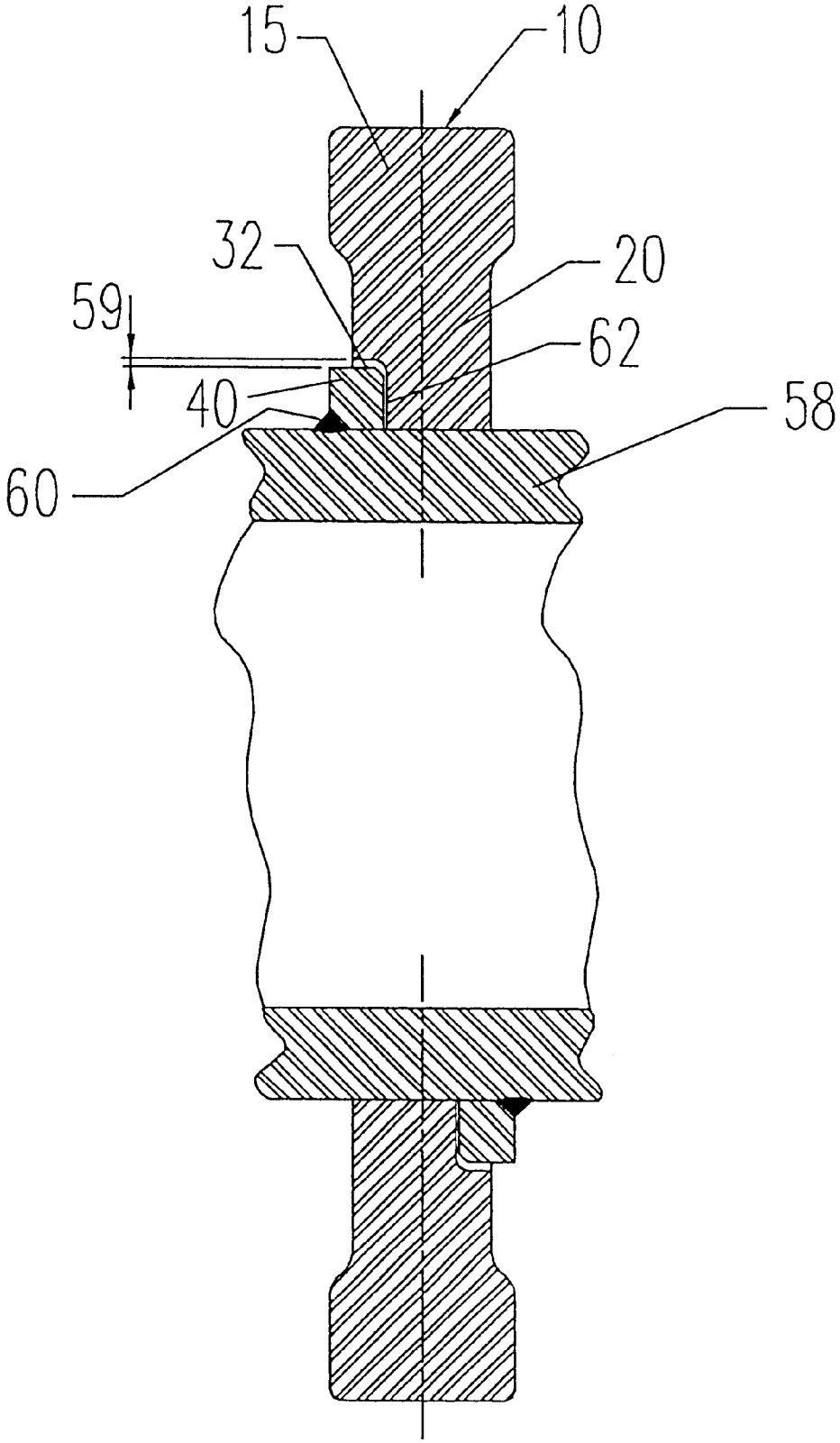
FIG. 4 is a cross sectional view of the tire of the present invention installed on the arbor of a furnace roller.

As shown in FIGS. 3A and 3B, an anchor member 40, preferably of the same material as the cast tire 10, has the form defining a circular ring sector with inner surface 42 and outer boundary surface 41 defined by radii one of which conforms to the radius of the outside diameter of an arbor used to support the tire and the other radius of outer boundary surface 41 conforms to the radius of the arcuate top surface 32 of pocket 30. The arcuate bottom surface 42 of the anchor member substantially conforms to the curvature of the radial surface defining the central opening of the hub portion of the tire. The rear top edge 48 of the anchor member is beveled to properly seat against the radial edges 31 of the pocket. The radial face surfaces forming boundaries of the angularly spaced pockets have their radial edges elongated to form moment arms to transmit torque from an applied force by the axial to rotate the tire and thus also the furnace roller. The front bottom edge 47 of the anchor member is beveled to accommodate the composite zone of a weld as further described below. Opposing end surfaces 46 of the anchor member are flat and join top surface 41 in an arcuate surface conforming to the shape of the pocket 30. The anchor member's opposing front and back sides 43 and 44, respectively are substantially flat. The overall dimensions of an anchor member 40 are such that it conforms to fill the space defined by pocket 30 with the following exceptions. As best shown in FIG. 4, the overall width of the anchor member 40 from front side 43 to back side 44 is longer in width than the depth of the pocket 30 and substantially equal to the width of the rim portion 15 of the tire. Additionally, a clearance gap 59 exists between the top surface 32 and rounded inner edge 34 of the pocket 30, and the outer boundary surface 41 and rear top edge 48 of the anchor member 40.

Figure 5:
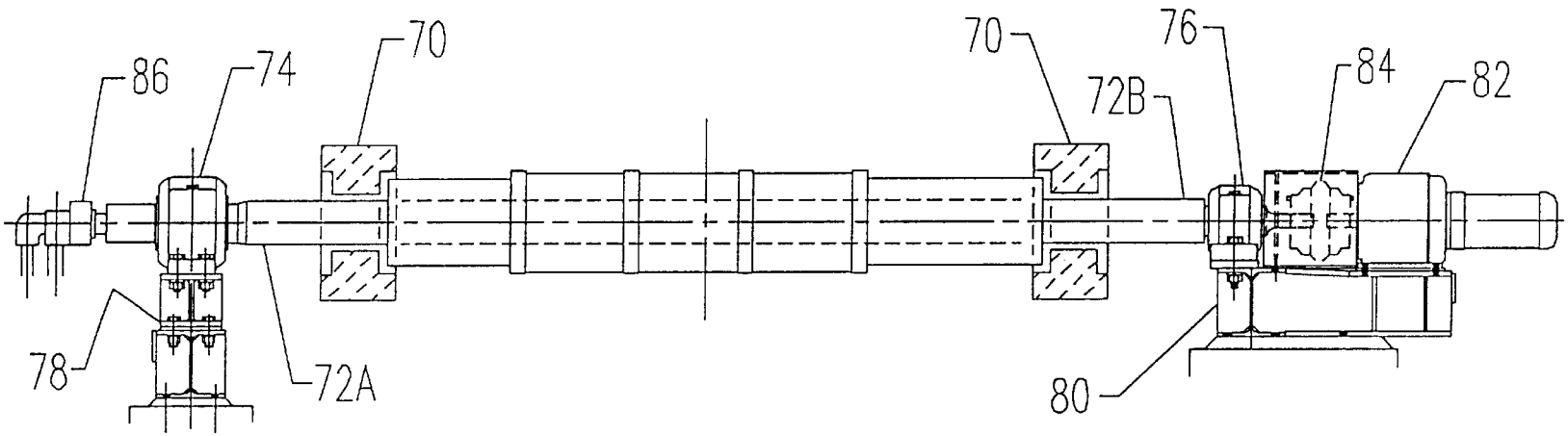
FIG. 5 is an elevational view illustrating the furnace roller of the present invention in its operative state forming part of a tunnel furnace.
Figure 9:
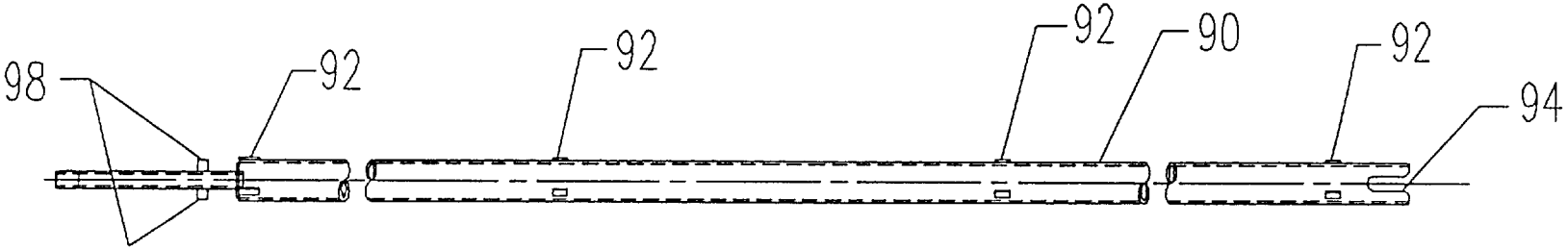
FIG. 9 illustrates an elongated core buster forming part of the furnace roller shown in FIG. 5.

The cast tire 10 of the present invention can be used with a furnace roller 50 shown in FIG. 5 includes a plurality of spaced apart workpiece supporting tires 10. FIG. 4 illustrates a tire 10 supported by an outer tubular surface of an arbor 58 also forming part of the furnace roller. The anchor member 40 is inserted into each pocket 30 on the tires. The anchor members 40 are welded to the outer tubular surface of an arbor 58. The composition zone of the weld 60 is substantially disposed within the beveled lower bottom edge of each anchor member 40. The anchor members 40 will keep the tires 10 in alignment (at 90 degrees to the axis of the arbor) and transmit the required torque from the rotating arbor primarily by the contact of the ends 46 of the anchor members 40 with the corresponding radial edges 31 to propel the strip product though the furnace. The width of the anchor member within the pocket, and consequently the depth of the pocket, is primarily determined by the magnitude of the required torque transmission. A design safety factor may be added to the depth of the pocket.

A spacing material 62, such as masking tape, can be placed between the back side 44 of the anchor member and the inner radial surface of the pocket 30. The spacing material 62 provides clearance between the surface of the pocket and rear surface of the anchor member 40 to allow for thermal expansion of the width of the tire 10 between the anchor members 40 that are welded to the arbor 58 and located on the opposing radial sides of the tire. Upon reaching operating temperature, the spacing material 62 will compress or burn off.

Figure 8:
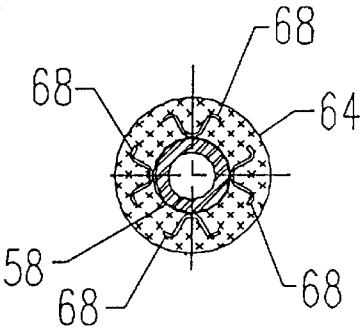
FIG. 8 is a sectional view taken along lines VIII—VIII of FIG. 7.
Figure 7:
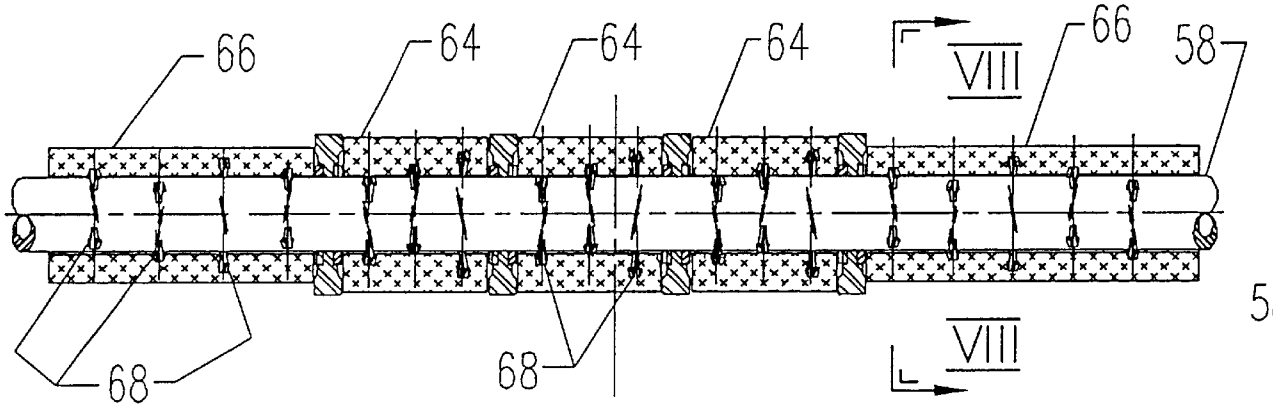
FIG. 7 is a sectional view illustrating final assembly of the furnace roller assembly depicted in FIG. 5.
Figure 6:
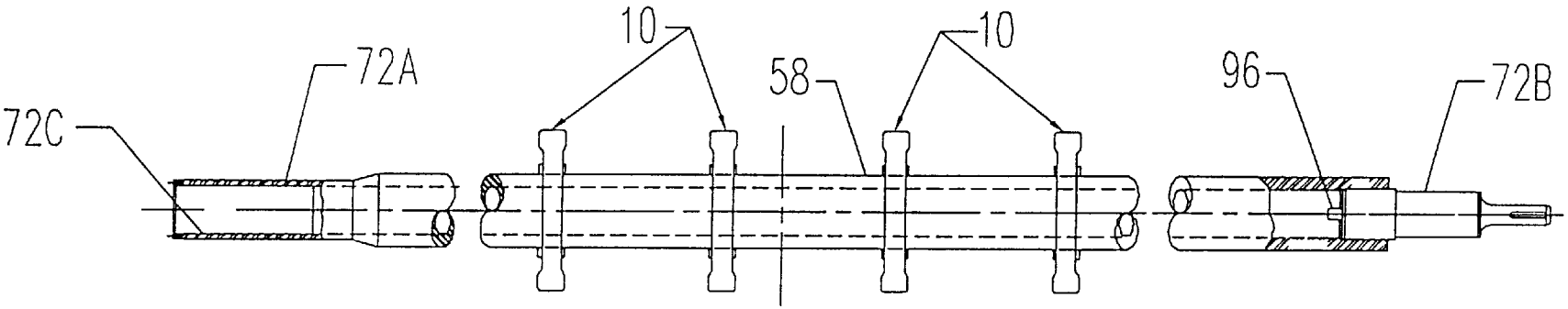
FIG. 6 is an elevational view partly in section illustrating spaced apart tires on an arbor for the furnace roller of FIG. 5.

As shown in FIGS. 5 and 6, four tires 10 are installed at spaced apart locations along the arbor 58 in the manner as just described. After installation of the cast tires 10 on the arbor 58 as shown in FIGS. 7 and 8, a body of castable insulation 64 separated by spacers from the arbor and the side wall of the tires is formed at each of the three locations between the tires. Additionally, a body of insulation 66 separated by spacers from the arbor and the side wall of the tires is formed along each of the terminal end portions of the arbor. In a manner known per se, anchors 68 affixed to the arbor along the length thereof serve to hold the castable insulation on the arbor. As shown in FIG. 5, the castable insulation and tires therebetween are located in a furnace between spaced apart furnace side walls 70 which are provided with apertures to allow arbor shaft extensions 72A and 72B to extend to support bearings 74 and 76 are mounted on pedestals 78 and 80. Outwardly of bearing 76, pedestal 80 supports a motor 82 connected by a coupling 84 to arbor shaft extensions 72B. Outwardly of bearing 74, the terminal end portion of arbor shaft is provided with a rotary coupling 86 for the supply and delivery of coolant water. The rotary coupling communicates with the internal cavity in a core buster segment 90. Spacers 92 projecting from the outer surface of the core buster segment at spaced locations along the length thereof, form a flow channel for coolant water emerging from a passageway 94. This passageway is elongated to take the form of a notch, the terminal end portion of which drivenly engages with a key 96 projecting from the inner face of arbor shaft extensions 72B. Arbor shaft extensions 72A has an internal threaded end portion 72C to receive a threaded end plug which abuts against lugs 98 on the core buster for retaining the core buster in seated engagement within the internal cavity of the arbor 58.

In one particular embodiment when a water-cooled furnace roller is exposed to a 2200° F. atmosphere, the tire temperature at the outer tubular member 58 of the arbor is approximately 1400° F., whereas the anchor members 40 are at a temperature of approximately 730° F. The thickness of the spacing material 90 compensates for the thermal expansion difference between the width of the 1400° F. tire and the 730° F. anchor member welded to the outer tubular member 58 of the arbor. Thus, a furnace roller using the cast tires 10 of the present invention results in a significant increase in thermal resistance between the tire and the outer tubular member of the arbor.

The present invention may be embodied in other specific forms without departing from the spirit or essential attributes thereof. Accordingly, reference should be made to the appended claims, rather than to the foregoing specification, as indicating the scope of the invention.

What is claimed is:

1. A cast tire for use in a furnace roller to support and advance a workpiece in a furnace, said cast tire including:

an outer rim portion having an annular peripheral tire face to engage and support a workpiece during conveyance thereof in a heated chamber of a furnace; and a continuous web portion having an inner most annular surface contiguous with said outer rim portion, said inner most annular surface defining a load-bearing seat for load-bearing support by an axle, said continuous web portion having oppositely directed radial face surfaces forming boundaries of angularly spaced pockets bounded by radial edges generally perpendicular to said inner most annular surface, said radial edges being elongated to form moment arms to transmit torque from an applied force by an axle to rotate said continuous web portion and said outer rim portion for conveying a workpiece.

2. The cast tire according to claim 1 wherein said continuous web portion is impervious to fluid flow to maintain a substantially constant temperate gradient radially from said load-bearing seat to said rim portion.

3. The cast fire according to claim 1 wherein said angularly spaced pockets comprise circular ring sector segments.

4. The cast tire according to claim 3 wherein said circular ring sector segments intersect said inner most annular surface.

5. The cast tire of claim 4 wherein said angularly spaced pockets in a first side of said continuous web portion are axially offset from the angularly spaced pockets on the second radial side by a spacing substantially equal to half the axial spacing between adjacent angularly spaced pockets.

6. The cast tire of claim 1 wherein the number of angularly spaced pockets in a first radial side of said continuous web portion is equal to the number of angularly spaced pockets in a second and opposite radial side of said continuous web.

7. The cast tire of claim 6 wherein the angularly spacing between angularly spaced pockets on each radial side is substantially equally.

8. The cast tire of claim 7 wherein the angularly spaced pockets on the first radial side are axially offset from the angularly spaced pockets on the second radial side by a spacing substantially equal to half the axial spacing between adjacent angularly spaced pockets.

9. The cast tire of claim 1 wherein said rim portion is a thickened enlargement to said continuous web portion.

10. The cast tire according to claim 1 wherein said angularly spaced pockets comprise discrete pockets disposed about a side face of said continuous web portion.

11. The cast tire according to claim 10 wherein the number of angularly space pockets in each of oppositely directed side face surfaces of said continuous web portion is equal.

12. The cast tire according to claim 1 wherein said angularly spaced pockets comprise at least three annular spaced pockets axially disposed around said inner most annular surface on each radial side of said continuous web portion.

13. The cast tire according to claim 12 wherein the angular spacing between adjacent pockets equals 120 degrees and the pockets on opposing radial sides of said continuous web portion are offset by 60 degrees.

14. A furnace roller for supporting a workpiece in a furnace, the furnace roller including:

a rotatable arbor;

a number of tires having substantially equal radial extending outer rim portions at axially spaced apart sites along said arbor for engaging a workpiece, each tire further comprising a continuous web portion having an inner most annular surface contiguous with said outer rim portion thereof, said inner most annular surface defining a load bearing seat for load bearing support by an axle, said continuous web portion having oppositely directed radial face surfaces forming boundaries of angularly spaced pockets bounded by radial edges generally perpendicular to said inner most annular surface, said radial edges being elongated to form moment arms to transmit torque from an applied force by an axle to rotate said continuous web portion and said outer rim portion for conveying a workpiece;

a plurality of anchor members seated in said pockets and drivingly secured to said arbor for rotation by the arbor; and thermal insulation supported by said arbor to provide a thermal barrier to extend radially between the tires, the insulation having a thickness terminating with an outer surface extending radially at least a substantial portion but less than the entire radii of the tires.

15. A furnace roller according to claim 14 wherein said anchor members define circular ring sectors having inner and outer boundaries surfaces defined by radii one of which conforms to a radius of the outside diameter of said arbor and the other conforms to a radial boundary of said pockets.

16. A furnace roller according to claim 15 further including weld metal to secure each anchor member essentially only to said arbor.

17. A furnace roller according to claim 14 wherein said arbor is further defined as a first pipe having a cylindrical internal cavity with a barrier wall at one end of the pipe to block the flow of fluid beyond the barrier wall and a passageway for fluid at the opposite end of the pipe, a core buster segment disposed within said first pipe to form a substantially annular first region between the inner surface of said first pipe and the outer surface of said core buster segment, said core buster segment having a fluid passageway at one end thereof for fluid flow between the inner passageway of core buster segment and the outer surface thereof whereby a continuous flow path for fluid is provided between the inner and outer surfaces of said core buster.

18. A furnace roller according to claim 14 wherein said continuous web portion is impervious to fluid flow to maintain a substantially constant temperature gradient radially from said load bearing seat to said rim portion.

19. The furnace roller according to claim 14 wherein said angularly spaced pockets comprise circular ring sector segments.

20. The furnace roller according to claim 19 wherein said circular ring sector segments intersect said inner most annular surface.

21. The furnace roller of claim 20 wherein said angularly spaced pockets in a first side of said container web portion are axially offset from the angularly spaced pockets on the second radial side by a spacing substantially equal to half the axial spacing between adjacent angularly spaced pockets.

22. The furnace roller of claim 14 wherein the number of angularly spaced pockets in a first radial side of said continuous web portion is equal to the number of angularly spaced pockets in a second and opposite radial side of said continuous web portion.

23. The furnace roller of claim 22 wherein the angularly spacing between angularly spaced pockets on each radial side is substantially equally.

24. The furnace roller of claim 23 wherein the angularly spaced pockets on the first radial side are axially offset from the angularly spaced pockets on the second radial side by a spacing substantially equal to half the axial spacing between adjacent angularly spaced pockets.

25. The furnace roller of claim 14 wherein said rim portion is a thickened enlargement to said continuous web portion.

26. The furnace roller according to claim 14 wherein said angularly spaced pockets comprise discrete pockets disposed about a side face of said continuous web portion.

27. The furnace roller according to claim 26 wherein the number of angularly space pockets in each of oppositely directed side face surfaces of said continuous web is equal.

* * * * *